United States Patent [19]

Schafer

[11] Patent Number: 4,701,966

[45] Date of Patent: Oct. 27, 1987

[54] TOILET STOOL INSTANT ODOR REMOVAL MEANS

[76] Inventor: Cyril L. Schafer, Rte. #2, Morrison, Ill. 61270

[21] Appl. No.: 35,182

[22] Filed: Apr. 7, 1987

[51] Int. Cl.[4] ..... E03D 9/04

[52] U.S. Cl. ..... 4/213

[58] Field of Search ..... 4/213, 216, 217

[56] References Cited

U.S. PATENT DOCUMENTS

| | | | |
|---|---|---|---|
| 1,774,156 | 8/1930 | Root | 4/213 X |
| 1,978,467 | 10/1934 | Malmberg | 4/213 |
| 2,728,088 | 12/1955 | Gudish | 4/217 |
| 3,295,147 | 1/1967 | Meyer | 4/213 |
| 3,523,309 | 8/1970 | Munden | 4/213 |
| 3,849,808 | 11/1974 | Olson et al. | 4/213 |
| 4,085,470 | 4/1978 | Roberts | 4/213 |

*Primary Examiner*—Charles E. Phillips

[57] ABSTRACT

An instant air free flow toilet stool odor removal means which comprises one disposable duct placed between the toilet seat hinges of any modern toilet stool, with the receptive opening of said disposable duct positioned under the rear edge of the toilet stool seat. The opposite end of said disposable duct being held in communication with a tubular manifold by retaining lugs molded on said manifold for use as a snap-on application of the disposable duct to said manifold. The manifold-duct combination being held in position by the toilet seat hinges and the forward wall of the toilet stool flush tank. A conduit is coupled in communication with said manifold and said conduit also coupled in communication with an air free flow centrifugal fan. The outlet port of said centrifugal fan is coupled in communication with a flap closing exterior wall vent to the exterior. Upon the use of the toilet stool and the activation of the air free flow centrifugal fan, thirty cubic feet per minute of air will flow through the toilet bowl conveying odors to the exterior.

8 Claims, 6 Drawing Figures

TOILET STOOL INSTANT ODOR REMOVAL MEANS

This invention in general terms is contrived to introduce a toilet stool instant odor removal means which is used to instantly remove odors from a toilet stool of modern design, and more specifically is used as a device to prevent odors from leaving a modern toilet stool and entering the living area adjacent to and around the other areas within the living abode.

There are several primary goals to this invention.

1. To provide a toilet stool instant odor removal means which can be installed on any modern toilet stool.

2. To provide a toilet stool instant odor removal means which includes a ducting device that can be discarded and replaced inexpensively if it should become contaminated.

3. To accomplish toilet stool instant odor removal with a device of simple design to insure against an unsightly finished product.

4. To provide a toilet stool instant odor removal means which is economically attainable.

BACKGROUND ART

There have been a number of attempts at removing odors from a toilet stool. All of them unsuccessful in the market place because of their unsightly applications and their susceptability to contamination during the time they are being used. Previous devices also require skilled people to perform the application to the toilet stool thereby eliminating the possibility of the application being done by the purchaser of the device.

Previous toilet stool odor removal devices have their odor removal means attached to the underface of the toilet stool seat and some of them with their odor removal means hanging over and/or into the interior of the toilet stool bowl. These have obviously not been accepted in the marketplace due to their disfiguring qualities along with their need for repeated cleanups.

Previous toilet stool odor removal devices have their action initiating switching devices attached on the toilet stool creating a very dangerous electronic accident situation with respect to electricity being too close to water.

THE CONDITION INITIATING THE INVENTION

The condition which necessitates this invention is created when human waste is expelled into any toilet stool. Odor immediately rises out of said toilet stool and pollutes the air of the surrounding area. To rectify this action, at the time a person is seated on said toilet stool, an immediate flow of air must be created to flow into the toilet stool through the same areas that the odor has been allowed to escape.

DISCLOSURE OF THE INVENTION

This invention is an air free flow toilet stool instant odor removal system in that it requires no seals or gaskets to be placed on the toilet stool and specifically the toilet seat or the toilet bowl rim. The free flow of air is motivated by an air free flow centrifugal fan, which has the capability of sixty cubic feet per minute of air movement with a running speed of three thousand revolutions per minute. The system consists of one disposable duct, one manifold, a length of conduit, coupling fittings, a sixty cubic feet per minute free flow centrifugal fan, and a falp closing external wall vent. The one and only odor removal disposable duct is made of plastic material and is of a very low profile rectangular shape when looking into the receptive end of said disposable duct. Said duct is seven sixteenths inches high and four inches wide. The length of said duct is made six inches long to be able to arrive at the proper length of said duct by trimming the odor receptive end to fit any manufactured brand of toilet stool. Said disposable duct is placed between the two toilet seat hinges, said hinges being a standard distance apart on all brands of toilet stools, in this position the odor receptive end of said disposable duct will be facing the rectal area of the person using said toilet stool. Said disposable duct is trimmed to just catch and slip under the extreme rear edge of the toilet stool seat.

The manifold is molded to plastic material, said manifold is a tubular shaped manifold, measuring not less than one and three sixteenths inches inside diameter. The length of said manifold is molded on foot long. This length will facilitate cutting the length to fit different width toilet stools. Said manifold is placed at the rear of the toilet seat hinges where said manifold will be positioned across the toilet stool in the narrow channel between the toilet seat hinges and the forward wall of the toilet stool flush tank and running parallel to the forward wall of said toilet stool flush tank. In this position the disposable duct is snapped on said manifold in the communicating cavity provided for in the rear of said disposable duct, (see drawings FIG. 3 and FIG. 5) and said manifold and said disposable duct being held in communication by holding lugs provided on said manifold. The manifold means, originally open ended to each end, provides an option of possible conduit communication from the end providing the most expedient, shortest route to the free flow centrifugal fan which is placed at the external wall for venting, wherein the external wall can be on any one of three sides, namely, right side, left side, or at the rear of the toilet stool. After the most expedient choice of conduit communication with said manifold is made, the opposite end of said manifold is capped.

A conduit means is coupled by push together compression fit couplings from the previously described most expedient end of said manifold to the free flow centrifugal fan placed at the external wall where the outlet of said free flow centrifugal fan is coupled to a flap closing external wall vent means to the exterior.

This invention will become more enlightened and more apparent by reference to the drawings wherein the related numerical identification will indicate the identical parts in the different illustrations.

BEST MODE FOR CARRYING OUT THE INVENTION WITH REFERENCE TO THE DRAWINGS

Figure 1:
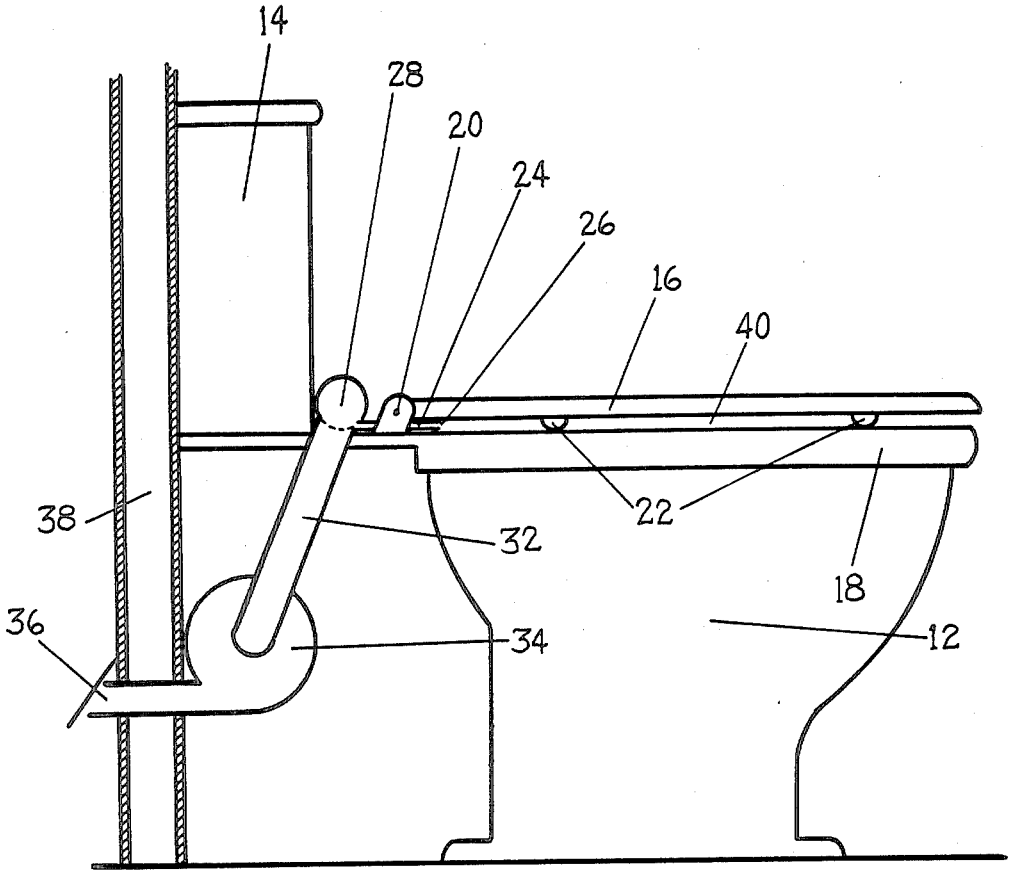
FIG. 1 is a side view of a modern toilet stool with the instant air free flow odor removal means installed on said modern toilet stool.

This invention is contrived to be applicable to any modern toilet stool, comprising a toilet bowl 12 with a bowl rim 18, a toilet seat 16, fastened to said toilet stool by hinge means 20, and a flush tank 14 which is an integral part of said toilet stool residing directly on the rear most portion of said toilet stool. The toilet seat 16 in normal usable position rests on the toilet bowl rim 18 by utilizing the usual provision of resilient seat rests 22, thereby allowing space between the toilet bowl rim 18 and the toilet seat 16, which in turn provides space for the required flow of replacement air to enter said toilet bowl 12.

Figure 2:
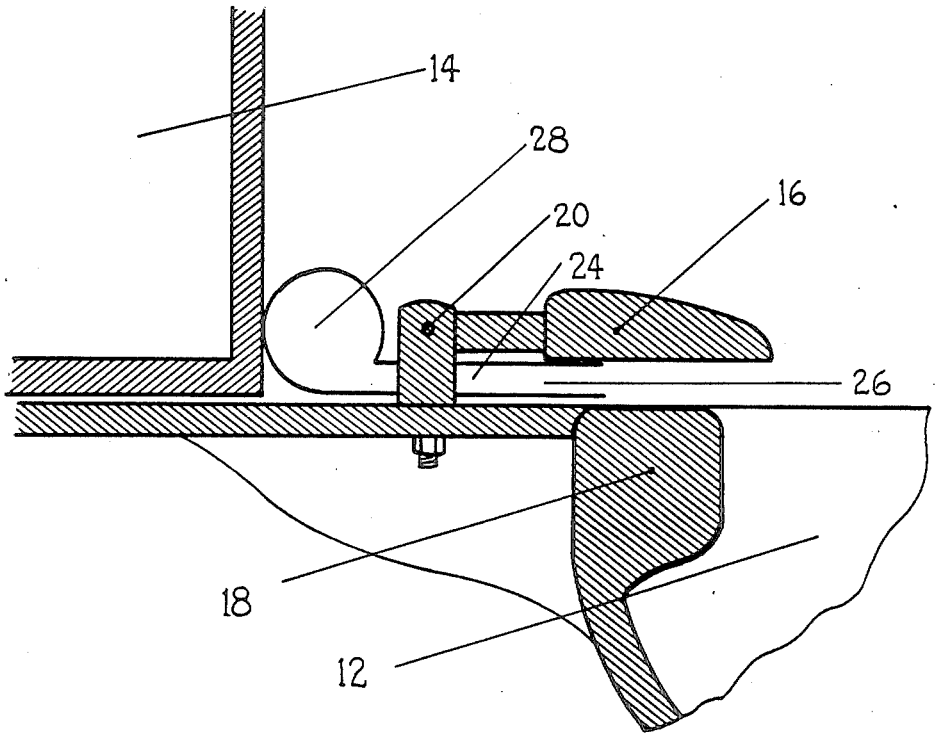
FIG. 2 is a sectional side view of a modern toilet stool illustrating the disposable duct and the manifold of the invention.
Figure 3:
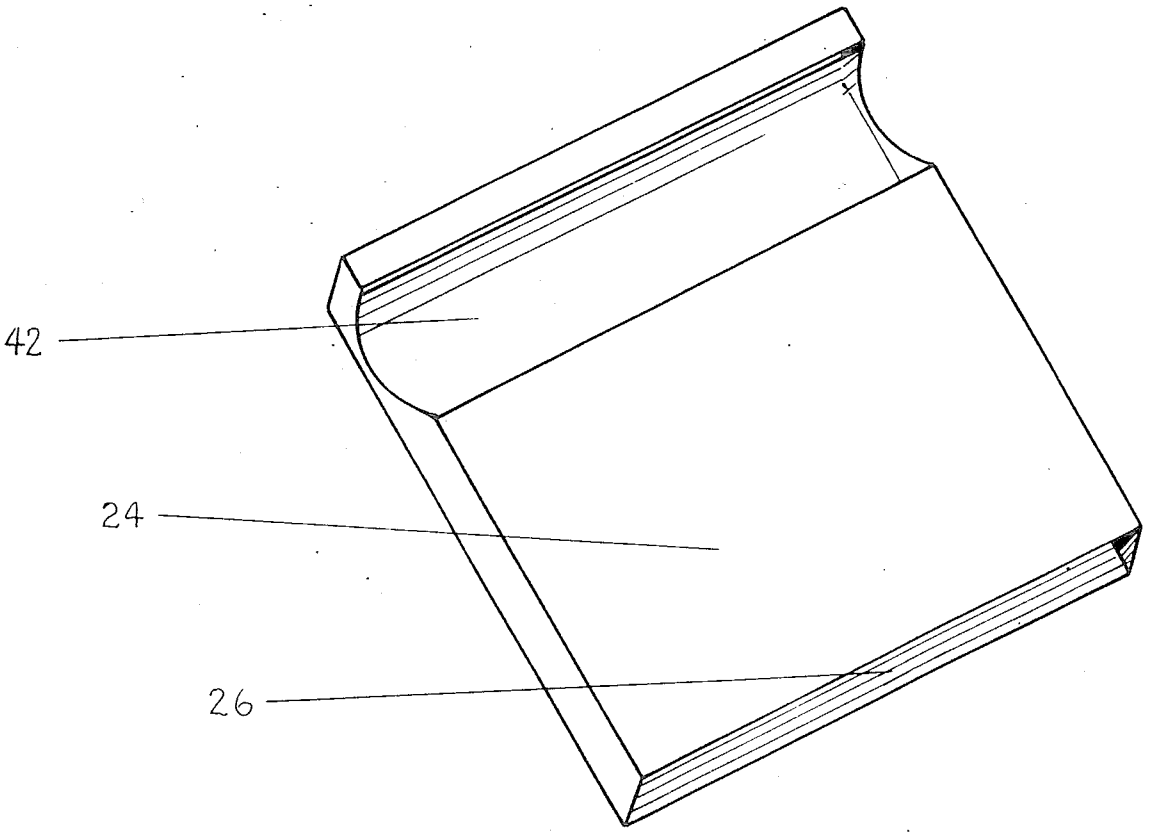
FIG. 3 is an isolated view of the disposable duct of the invention in a separated mode from the manifold of the invention.
Figure 4:
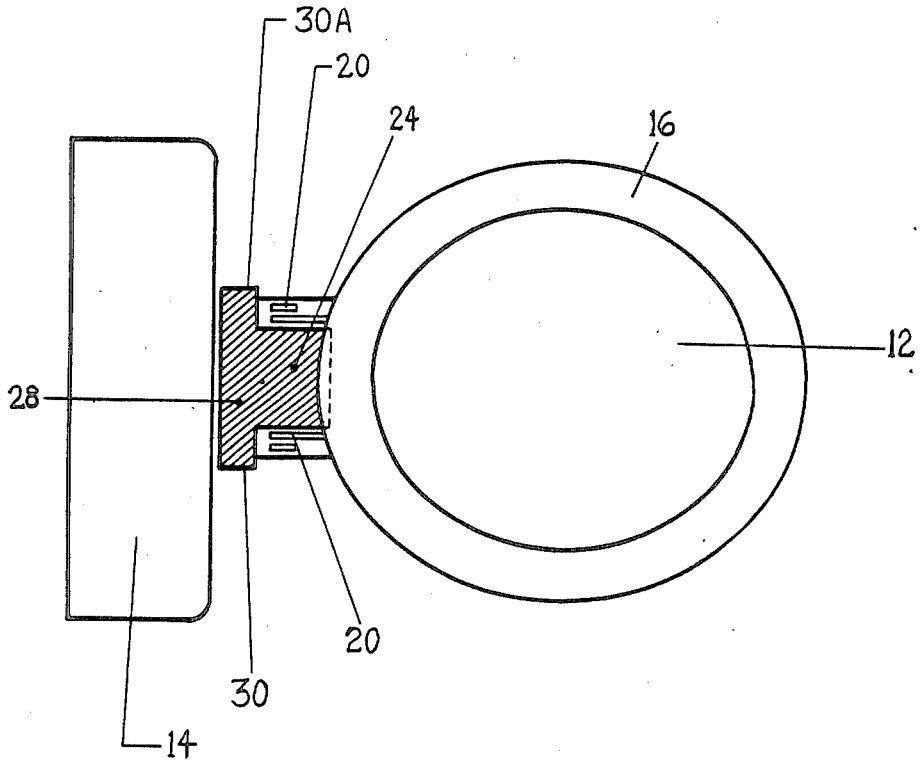
FIG. 4 is a top plan view of a modern toilet stool with the manifold and the disposable duct of the invention shown in the hatched segment installed at the hinged area of the toilet stool seat.

Referring to all drawings which will best describe the instant air free flow toilet stool odor removal means of the invention which comprises;

a disposable duct 24 in communication with a manifold 28 and specifically referring to FIGS. 1-2-4 which shows the disposable duct 24 in communication with the manifold 28 installed on the toilet stool with said duct 24 placed thereon and between the two toilet seat hinges 20, and the odor receptive end 26 of said disposable duct 24 facing the rear of the top opening of the toilet bowl 12.

Referring to FIGS. 1-2-4 the manifold 28 being placed in communication across the rear of the disposable duct 24 will therefore be resting laterally in the narrow area between the toilet seat hinges 20 and the front wall of the toilet stool flush tank 14.

Referring to FIGS. 1-2-4, the disposable duct, comprised of plastic material is trimmed at the odor receptive end 26 to just catch the rear most portion of the underface of the toilet seat 16 by the most minimal amount possible.

Referring to FIGS. 1-2-4, the manifold 28 and the disposable duct 24 in their integrated mode, are being held in place in all directions by the combination of the toilet seat hinges 20 and the forward wall of the toilet stool flush tank 14 providing assurances that the odor receptive end 26 of said disposable duct 24 will not protrude over the rear most edge of the toilet bowl rim 18 which will guard against contamination of said disposable duct 24 during usage of the toilet stool.

Referring to FIG. 1 which will show the manifold 28 coupled in communication with a conduit 32 which in turn is coupled in communication with a free flow centrifugal fan 34 which in turn is coupled in communication with a flap closing exterior wall vent means 36 which communicates through an exterior wall 38.

Referring to FIG. 1 which shows arrows 40 representing the areas where free flow replacement air will enter the toilet bowl 12 between the toilet bowl rim 18 and the underface of the toilet seat 16. Replacement air 40 will also enter the toilet bowl 12 above the toilet seat 16 between the thighs and at the base of the spine of the person seated on the toilet seat 16.

Upon usage of the toilet stool along with activation of the free flow centrifugal fan 34, replacement free flow air represented by arrows 40 immediately enters the toilet bowl 12 and is swept across the rectal area of the person seated on the toilet seat 16 and into the receptive opening 26 of said disposable duct 24, and through the manifold 28, and continues through the conduit means 32, and through the free flow centrifugal fan 34, and directly to the exterior through the flap closing exterior wall vent means 36.

Figure 5:
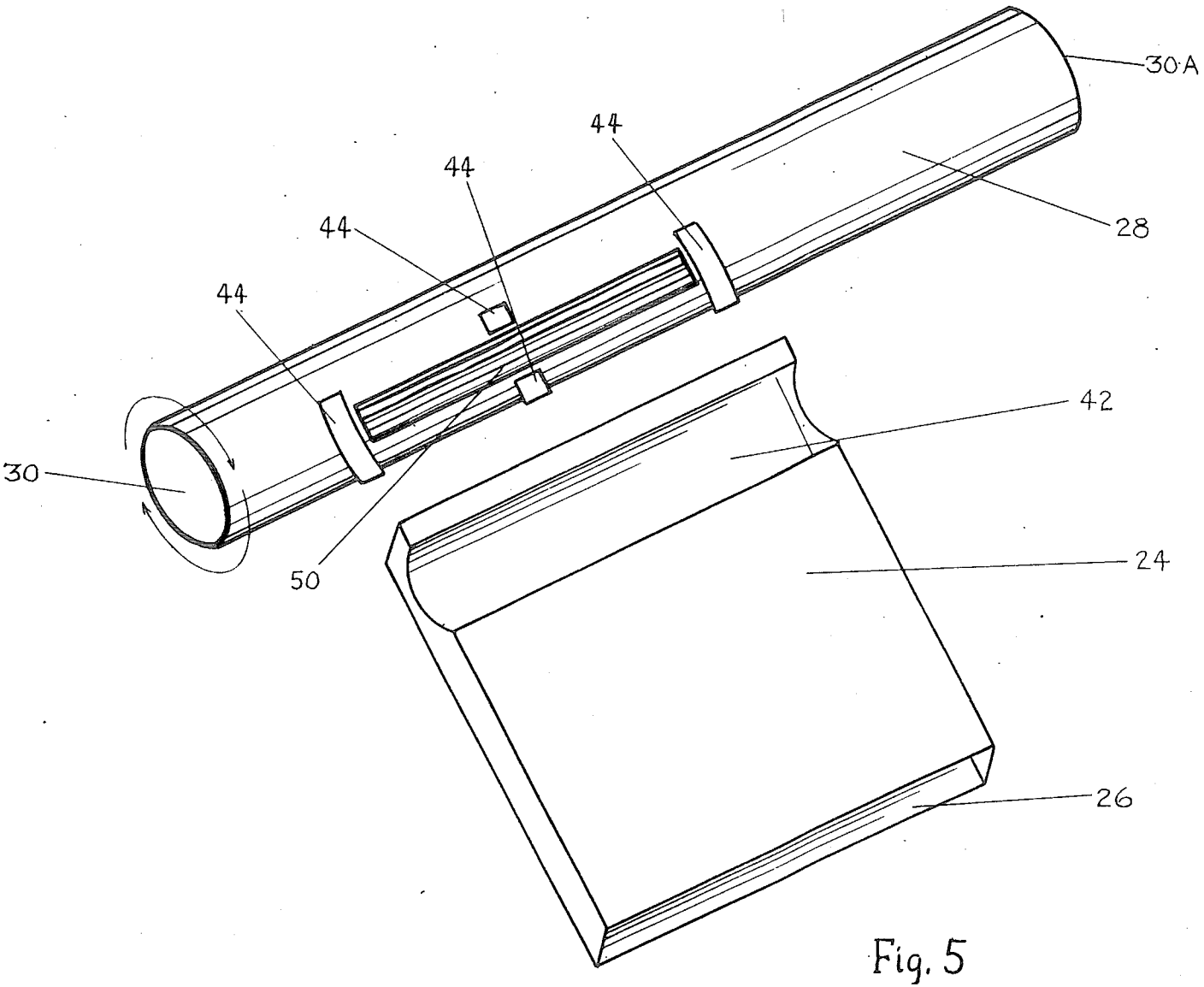
FIG. 5 is an illustration of the disposable duct of the invention showing the area (42 in FIG. 3 and 5) where the disposable duct joins the manifold of the invention, and an illustration of the manifold of the invention showing the air flow intake opening and the snap on disposable duct retaining lugs.

Referring to FIG. 5 which will show the disposable duct snap-on holding lugs 44 disposed around the odor-air receptive opening 50 on the manifold 28.

It is necessary to point out the advantages of having the most expedient shortest route possible to the external wall for venting purposes. The external wall can be on any one of three sides of the toilet stool, namely, right side, left side, or at the rear of said toilet stool. There must be a short as possible conduit 32 route to the free flow centrifugal fan 34 placed at the external wall 38 to avoid the development of a rambling conduit means 32 around the toilet stool leading from the manifold 28 to the external wall.

Referring to FIG. 5, the disposable duct 24, which is joined to the manifold 28 by the use of lug means 44, provides a versatile expedient to arrive at the shortest conduit route to the external wall regardless of the position of the external wall with respect to the toilet stool. With one end of manifold means 28 capped, the manifold means 28 has the option of the most expedient shortest conduit means routing to the external wall by simply removing the manifold 28 from the disposable duct 24 and turning said manifold 28 laterally one hundred and eighty degrees and clipping said manifold 28 back on said disposable duct 24.

Referring to FIG. 5, manifold 28 is shown open at both ends numbered 30 and **30*a* which provides a possibility of coupling conduit 32 from either end 30 or 30*a* of manifold 28 and capping the opposite end, which will also provide an expedient shortest conduit route to the free flow centrifugal fan 34** at the nearest external wall for venting purposes regardless of the position of the external wall relative to the position of the toilet stool.

Referring to FIGS. 1–5 with one end of manifold means 28 capped, the free flow centrifugal fan 34, with a speed of three thousand revolutions per minute will move air through the toilet bowl 12 at thirty cubic feet per minute. This is a more than an adequate flow. However, a doubling of air flow can be attained by coupling the manifold 28 in communication with the free flow centrifugal fan 34 from both ends 30 and **30*a* of manifold 28** simultaneously.

Referring to FIG. 5, if the disposable duct 24 should become contaminated, it can be disengaged from the manifold 28 and inexpensively replaced by clipping a replacement disposable duct 24 on the lugs 44 of said manifold 28 with out disturbing any parts of the toilet stool means.

Referring to FIGS. 1-2-4-5-6, to instantly remove odors from the toilet stool, it is necessary that the manifold 28 and all succeeding conduit 32 leading into and including the intake of the free flow centrifugal fan 34 to have an inside diameter of not less than one and three sixteenths inches and the outlet of the free flow centrifugal fan 34 to have an inside diameter of not less then one and three sixteenths inches and said free flow centrifugal fan 34 to have a speed of three thousand revolutions per minute.

Figure 6:
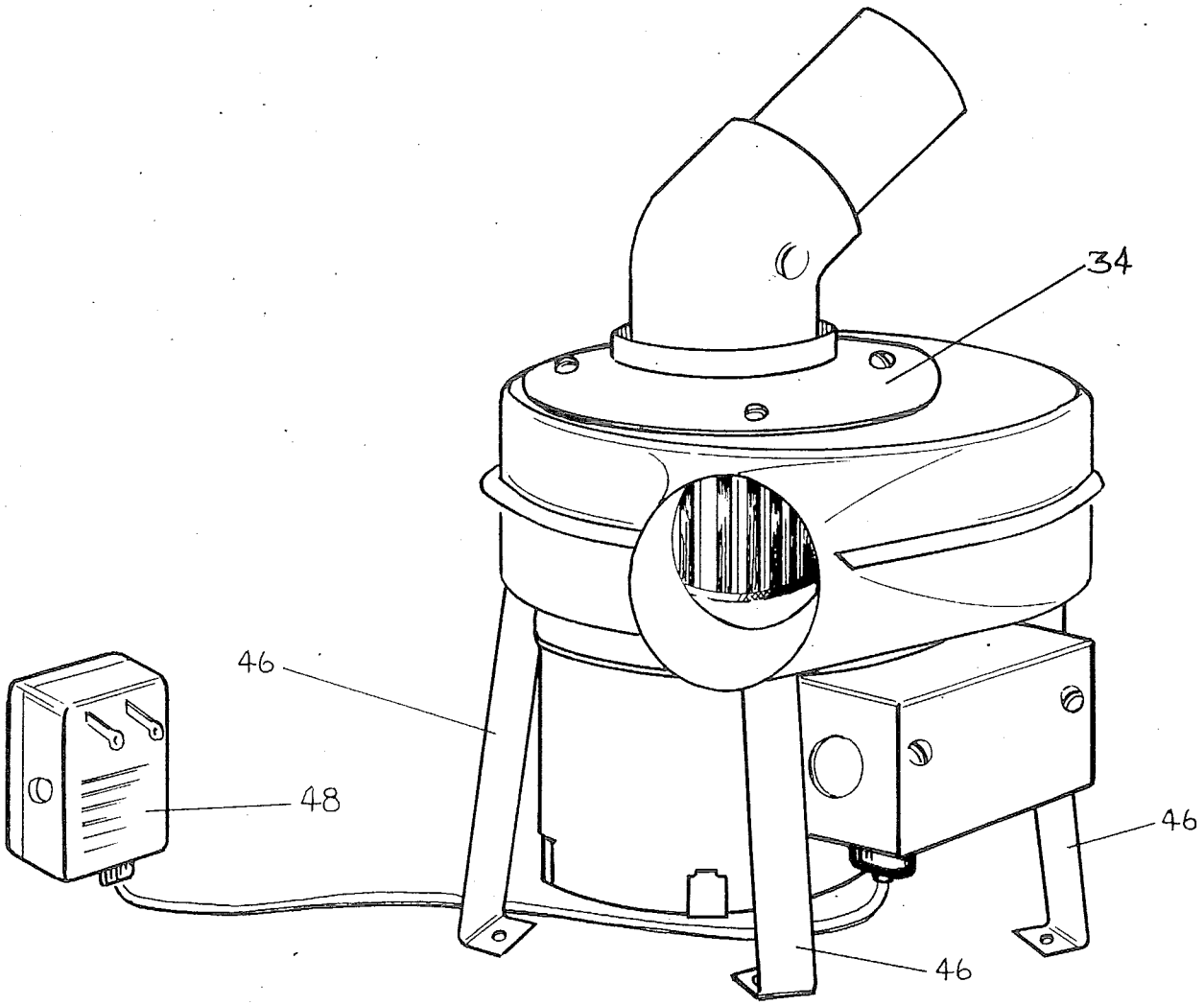
FIG. 6 is an illustration of the air free flow centrifugal fan utilizing a tripod leg stand mode and the wireless remote control isolation switching signal receiver to be plugged into an electrical wall receptical.

Referring to FIG. 6, in the present working and preferred embodiment of this invention, the free flow centrifugal fan 34 is activated by a remote control isolated switching device 48 which consists of a small hand held transmitter and a plug in electrical wall receptacle receiver 48 which isolates all electrical wiring away from the toilet stool to ensure against electric shock accident. Electrical switching can also be accomplished by a floor treadle means and also by the use of an under the toilet seat 16 pressure micro switch switching means.

Referring to FIG. 6, which will illustrate the free flow centrifugal fan 34 positioned on a tripod stand mode 46 which will create greater portability for said free flow centrifugal fan 34.

Referring to all drawings, it is important to note that no fastenings devices have been used to apply the instant air free flow odor removal means to the toilet stool and all the working devices on said toilet stool retain their original working state.

Referring to FIG. 1, which will show that with a person seated on the toilet seat 16 and replacement air entering the toilet bowl 12 at the areas designated by the arrows 40, and with thirty cubic feet per minute of replacement air entering said toilet bowl, it will be impossible for any odor to escape from the toilet bowl 12.

This instant air free flow odor removal ducting means can be integrally molded into new toilet stools during the manufacturing process.

Having thus presented a description of my invention, I claim:

1. An instant air free flow toilet stool odor removal means which is adaptable for use on any modern toilet stool placed within the confines of a room having an external wall for venting purposes, said external wall having a possibility of being located on any one of three sides of said toilet stool, namely, right hand side, left hand side, and the rear of said toilet stool, said modern toilet stool comprising a bowl with a bowl rim molded on the top of said modern toilet stool on a horizontal plane, a toilet seat and a toilet seat cover fastened together by dual purpose hinges which include two threaded bolts inserted through two holes molded at a standard distance apart and at a standard distance from the rear most portion of the toilet bowl rim;

a flush tank fastened directly on the rear most portion of said modern toilet stool and on the same horizontal plane as the previously described toilet seat, wherein said flush tank is an integral part of a modern toilet stool;

said instant air free flow toilet stool odor removal means comprising;

a plastic disposable duct having a wide very low profile odor-air receptive end, the width of said disposable duct allowing said disposable duct to be placed between said hinge bolts of the toilet seat and said disposable duct having a low enough profile to allow the odor-air receptive end to slip under the rear most portion of the toilet seat wherein the odor-air receptive end of said disposable duct is held between the toilet bowl rim and the underface of the rear most portion of the toilet seat; opposite the odor-air receptive end of said disposable duct between said bolts and tank and across the top rear width dimension of said disposable duct is a concave cavity communicating with said duct;

an odor-air receiving manifold of plastic material molded in a circular tubular shape containing a rectangular odor-air receiving opening running lengthwise and midway between the ends of said manifold, and disposed around said rectangular opening are lugs molded in the proper position as fastening devices utilizing a snap-on action to accept and hold said disposable duct when said manifold is seated in said concave cavity with said opening communicating with said duct, said manifold positioned on the top horizontal plane of the toilet bowl and at the rear of said toilet bowl and running generally parallel to the forward wall of the toilet stool flush tank, within the narrow area between the forward wall of the toilet stool flush tank and the toilet seat hinges, said odor-air receiving manifold extending in both directions beyond each side of the top horizontal plane of the toilet stool, wherein at this position said manifold is in clipped on communication with said disposable duct;

conduit means adapted to be coupled from a choice of the ends of said manifold into the intake opening of the a fan wherein upon activation of said said fan, a free flow of odor-air is created flowing through the toilet bowl and into said duct-manifold and conveyed through said conduit means and through said fan to the exterior, thereby accomplishing the removal of odors from the toilet bowl at the saem instant odors are expelled into said toilet bowl by the person using the toilet stool.

2. The instant air flow toilet stool odor removal means of claim 1 wherein the manifold-disposable duct assembly of said toilet stool odor removal means can be, if necessary, lifted away from the modern toilet stool, there being only one conduit coupling and no part of said odor removal means mechanically attached to said modern toilet stool.

3. The instant air free flow toilet stool odor removal means of claim 1 wherein the plastic tubular manifold has a coupling opening at each end thereby providing a choice to facilitate the most expedient coupling to the conduit which will provide the shortest possible route to said fan.

4. The instant air free flow toilet stool odor removal means of claim 1 wherein the plastic tubular manifold having the capability of being detached from the disposable duct, can provide a choice of conduit coupling from either side of the toilet stool by disengaging said manifold from said disposable duct and turning said manifold laterally one hundred and eighty degrees and re-engaging said manifold with said disposable duct, thereby providing the shortest possible conduit direct route to the external wall for venting purposes and eliminating a rambling conduit means around the toilet stool.

5. The instant air free flow toilet stool odor removal means of claim 1 wherein, upon the possible contamination of the disposable duct of said odor removal means, said disposable duct can be detached from the odor-air receiving manifold, disposed of and replaced by snapping a replacement disposable duct onto the holding lugs of said manifold means without disturbing the functioning means of the toilet stool.

6. The instant air free flow toilet stool odor removal means of claim 1 wherein toilet stool odor removal must be instantaneous to be successful thereby dictating that the proper volume of air must be communicated through the toilet bowl, which necessitated that the inside diameter of the manifold and all of the succeeding communicating conduit into and including the intake receptacle of said fan to have an inside diameter of not less than one and three sixteenths inches and the outlet of said fan and an external wall vent to have an inside diameter of not less than one and three sixteenths inches and a fan speed of three thousand revolutions per minute to attain a replacement air movement of thirty cubic feet per minute through the toilet bowl with the person using the toilet stool seated thereon.

7. The instant air free flow toilet stool odor removal means of claim 1 wherein the person using the toilet stool is protected from electrical injury and possible fatality by the use of a wireless remote control switching means consisting of a hand held wireless remote control on-off transmitter and a plug-in electrical wall receptacle receiver which is utilized to activate and de-activate the free flow centrifugal fan.

8. The instant air free flow toilet stool odor removal means of claim 1 wherein the air said fan is installed on a tripod floor stand to provide the greatest possible choice for through the exterior wall venting.

* * * * *